US006405660B2

(12) United States Patent
Itakura et al.

(10) Patent No.: US 6,405,660 B2
(45) Date of Patent: Jun. 18, 2002

(54) WAGON

(75) Inventors: Ushio Itakura; Osamu Ishii, both of Tokyo (JP)

(73) Assignee: Jamco Corporation, Tokyo (JP)

( * ) Notice: Subject to any disclaimer, the term of this patent is extended or adjusted under 35 U.S.C. 154(b) by 0 days.

(21) Appl. No.: 09/776,633

(22) Filed: Feb. 6, 2001

(30) Foreign Application Priority Data

Feb. 10, 2000 (JP) ..... 2000-033633

(51) Int. Cl.[7] ..... A47B 3/00
(52) U.S. Cl. ..... 108/115; 108/38
(58) Field of Search ..... 108/95, 92, 91, 108/115, 38, 34, 35; 211/149, 150, 195, 130

(56) References Cited

U.S. PATENT DOCUMENTS

| | | | | |
|---|---|---|---|---|
| 2,926,794 A | | 3/1960 | Karoff | |
| 3,149,726 A | * | 9/1964 | Magers | |
| 3,415,208 A | * | 12/1968 | Thoresen et al. | |
| 3,436,092 A | * | 4/1969 | Werner | |
| 3,527,174 A | * | 9/1970 | Lay | 108/115 |
| 3,656,439 A | * | 4/1972 | Domin | 108/115 X |
| 5,224,531 A | * | 7/1993 | Blohm | 108/115 X |
| 5,622,119 A | * | 4/1997 | Hsieh | 108/115 |
| 5,904,104 A | * | 5/1999 | Yu | 108/115 X |
| 6,053,116 A | * | 4/2000 | Jung et al. | 108/115 |
| 6,240,855 B1 | * | 6/2001 | Pirkl et al. | 108/115 |

FOREIGN PATENT DOCUMENTS

| | | |
|---|---|---|
| EP | 0 888 736 A2 | 1/1999 |
| GB | 688131 | 2/1953 |

* cited by examiner

*Primary Examiner*—Jose V. Chen
(74) *Attorney, Agent, or Firm*—Armstrong, Westerman, & Hattori, LLP.

(57) ABSTRACT

A wagon 1 comprises a first wagon 10 including a lower face plate 12 and an upper face plate 11 constituting storage space, and a second wagon 20 to be stored within the storage space of the first wagon 10. The longitudinal side edges of the upper face plate 11 of said first wagon 10 is equipped with auxiliary table plates 15 rotatably connected thereto, and the first and second wagons 10, 20 are formed to rotate with the rotary axis set to a center column 30 mounted to the center of the upper and lower face plates 11, 25, 12, 21. The second wagon 20 can be moved from a first position where the wagon is completely stored within the first wagon 10 to a second position taking an angle of 90 degrees from the first wagon, and the auxiliary tables 15 can each be pivoted from a position hanging from the upper face plate 11 to a position leveled with the upper face plate 11. The second wagon 20 comprises a supporting mechanism equipped to the lower face plate 21, so that when the second wagon 20 is rotated to said second position, the supporting mechanism 95 supports the second wagon 20 to the leveled position.

6 Claims, 10 Drawing Sheets

WAGON

FIELD OF THE INVENTION

The present invention relates to a wagon capable of further serving also as a table.

DESCRIPTION OF THE RELATED ART

The wagon conventionally used to transport food, beverage and the like are for serving food and the like while moving the wagon. Therefore, the wagon body is formed narrow, normally 30 cm×81 cm, and it was unstable to use the upper surface as a table.

SUMMARY OF THE INVENTION

Therefore, the present invention provides a wagon that is equipped with a mechanism enabling the wagon be used as a table, which can safely transport food and beverage, and at the same time, can easily be set to a desired position as a table for serving food and beverage.

The wagon according to the present invention is equipped with a first wagon having a lower face plate and an upper face plate, and constituting a storage space between the lower and upper face plates, and a second wagon stored within the storage space of the first wagon.

An auxiliary table plate is connected to the longitudinal side edge of the upper face plate of the first wagon. The second wagon is mounted so as to rotate from a first position where the second wagon is completely stored inside the first wagon to a second position rotated to an angle of 90 degrees from the first wagon. The auxiliary table is mounted so that it can be pivoted from a position hanging down from the upper face plate to a position leveled with the face plate.

When the second wagon is at the first position, the auxiliary table plate hangs down so as to cover the storage space of the first wagon, and when the second wagon is at the second position, the auxiliary table plate is pivoted to level with the upper face plate of the first wagon, where the second wagon serves as a supporting member supporting the auxiliary table plate to the position leveled with the upper face plate of the first wagon.

Moreover, the first and second wagons are formed to rotate, the rotation axis positioned at the center of the upper and lower face plates of each wagon.

The second wagon has a supporting mechanism equipped to the lower face plate thereof, and when the second wagon is rotated to the second position, the support mechanism supports the second wagon at a leveled position.

The supporting mechanism of the second wagon includes a drive unit driven along with the rotation of the second wagon, comprising a cam groove mounted to the lower face plate of the first wagon, and a support member mounted to the lower face plate of the second wagon including a cam follower guided by the cam groove and a link mechanism.

Moreover, the wagon is equipped with a glass holder mounted to the back surface of the upper face plate of the second wagon.

DETAILED DESCRIPTION OF PREFERRED EMBODIMENTS

The embodiment of the present invention will now be explained with reference to the drawings.

Figure 1:
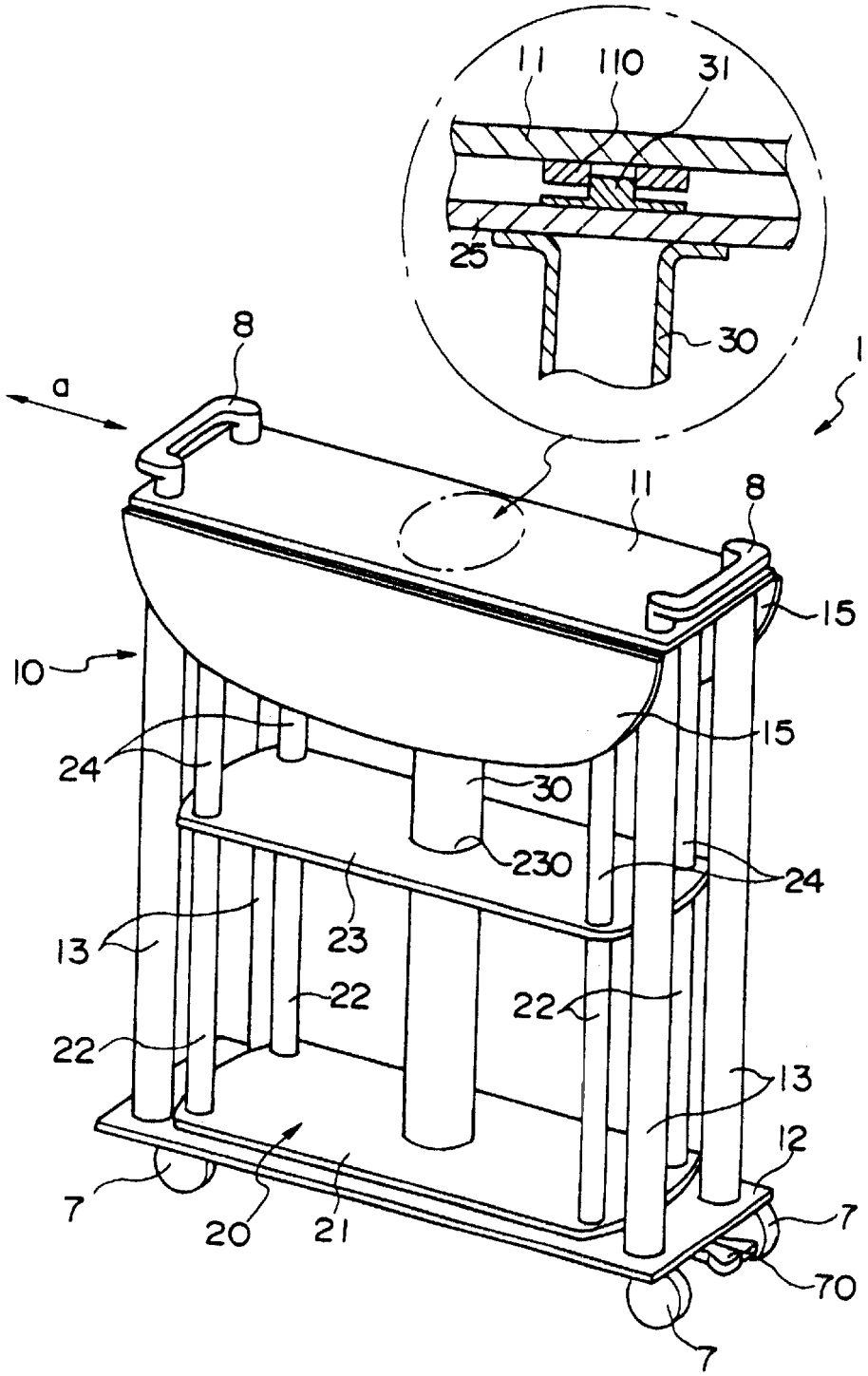
FIG. 1 is a perspective view of the wagon according to the present invention.
Figure 2:
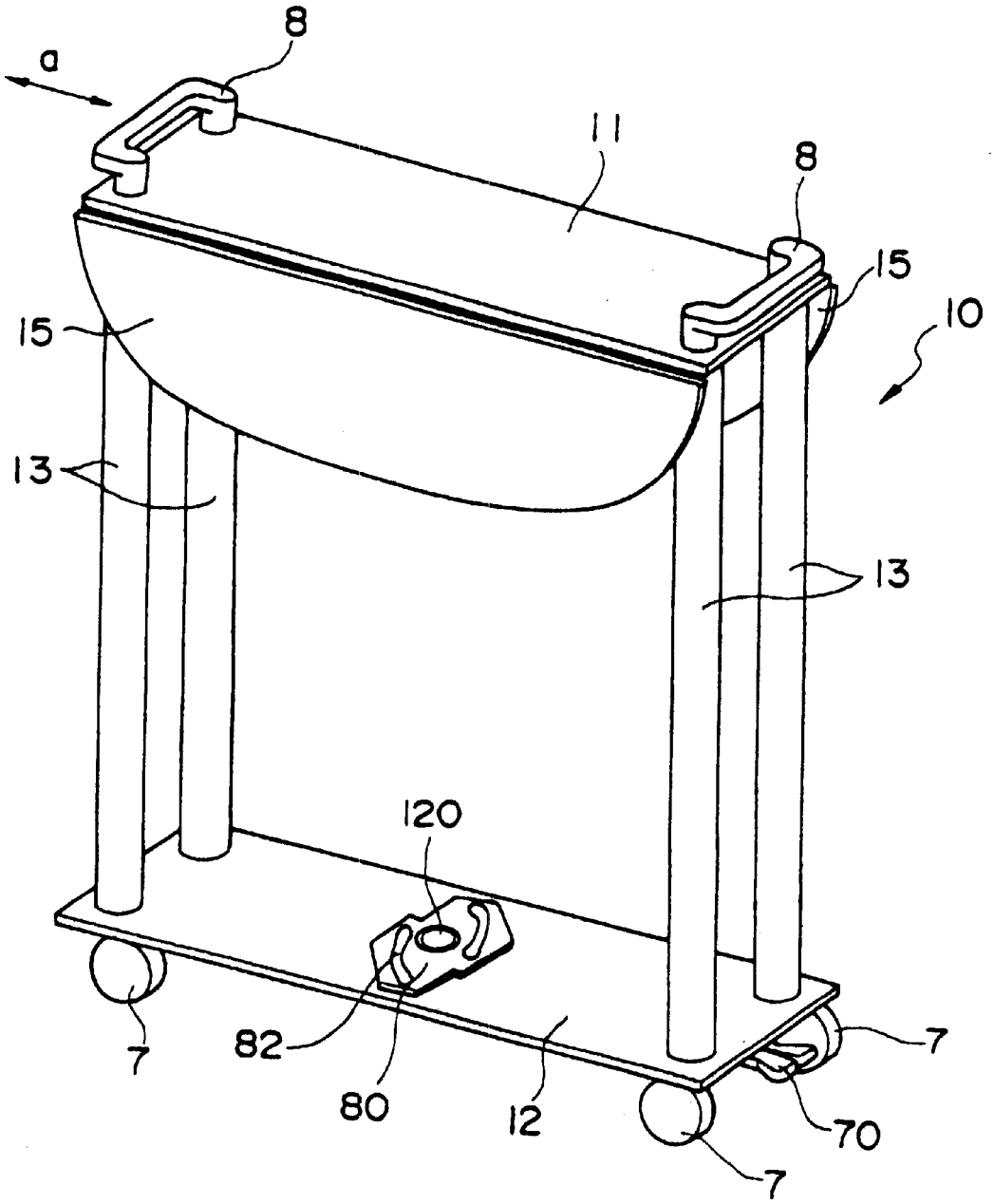
FIG. 2 is a perspective view of the first wagon.
Figure 3:
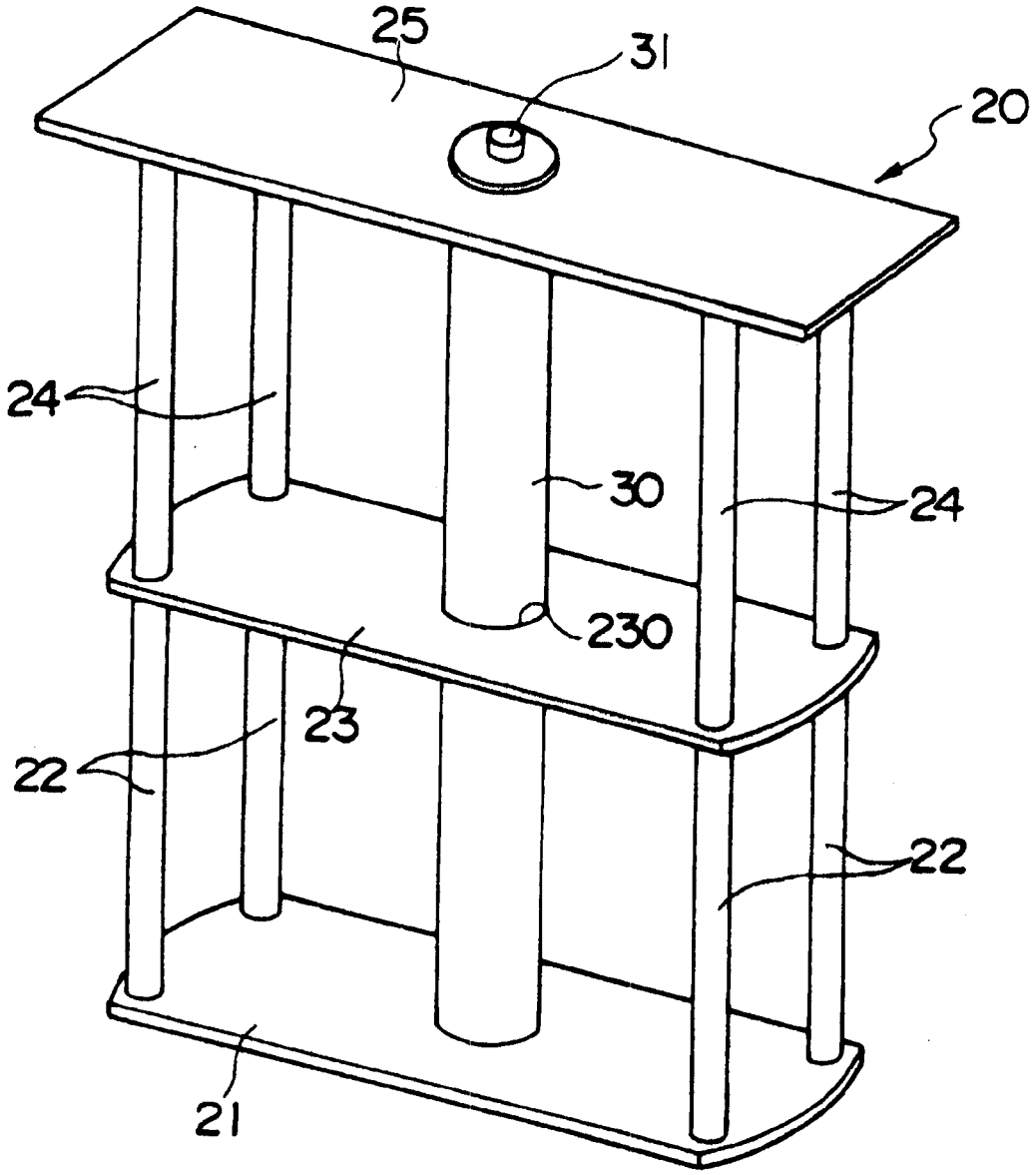
FIG. 3 is a perspective view of the second wagon.
Figure 4:
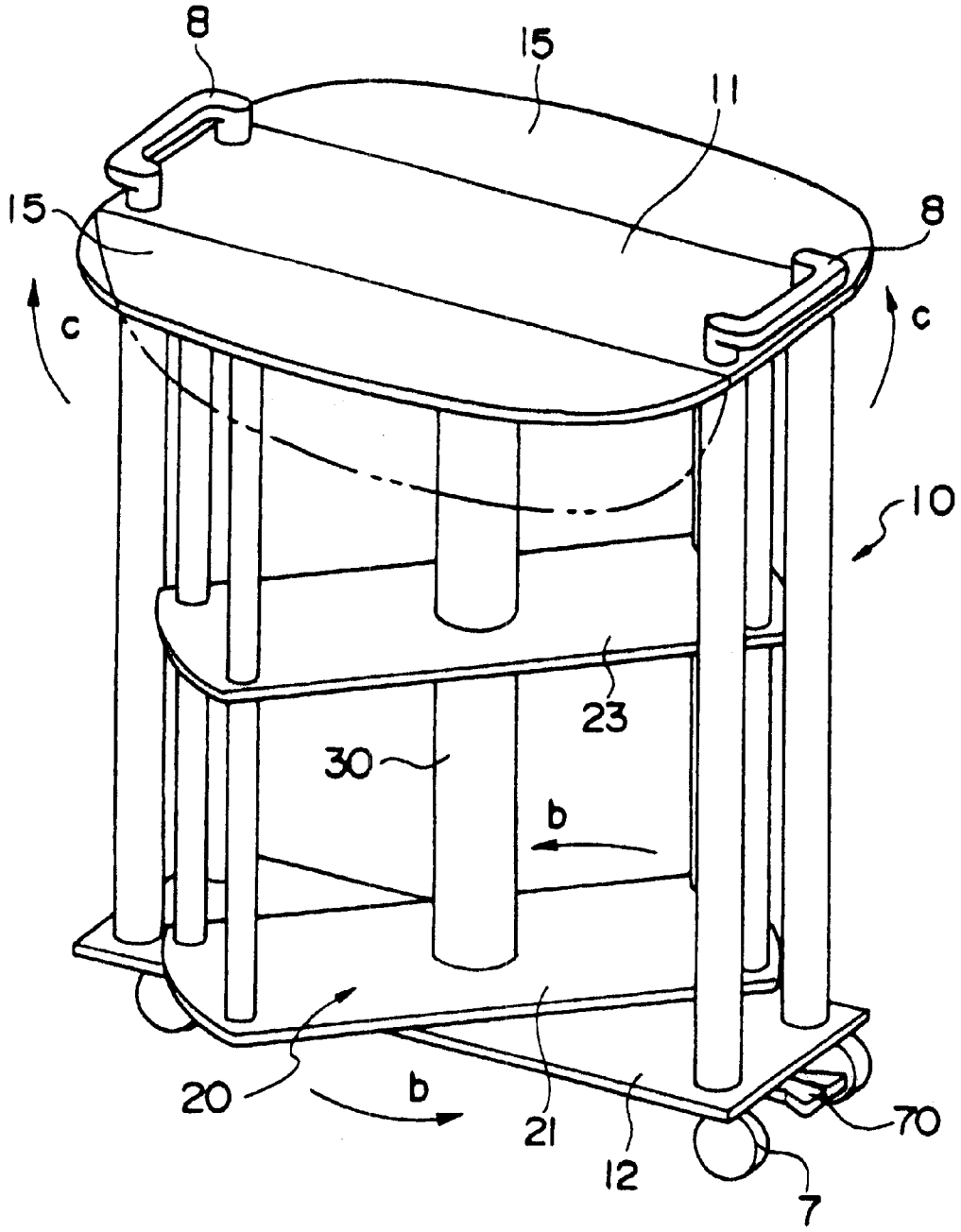
FIG. 4 is an explanatory view showing the operation of the wagon according to the present invention.
Figure 5:
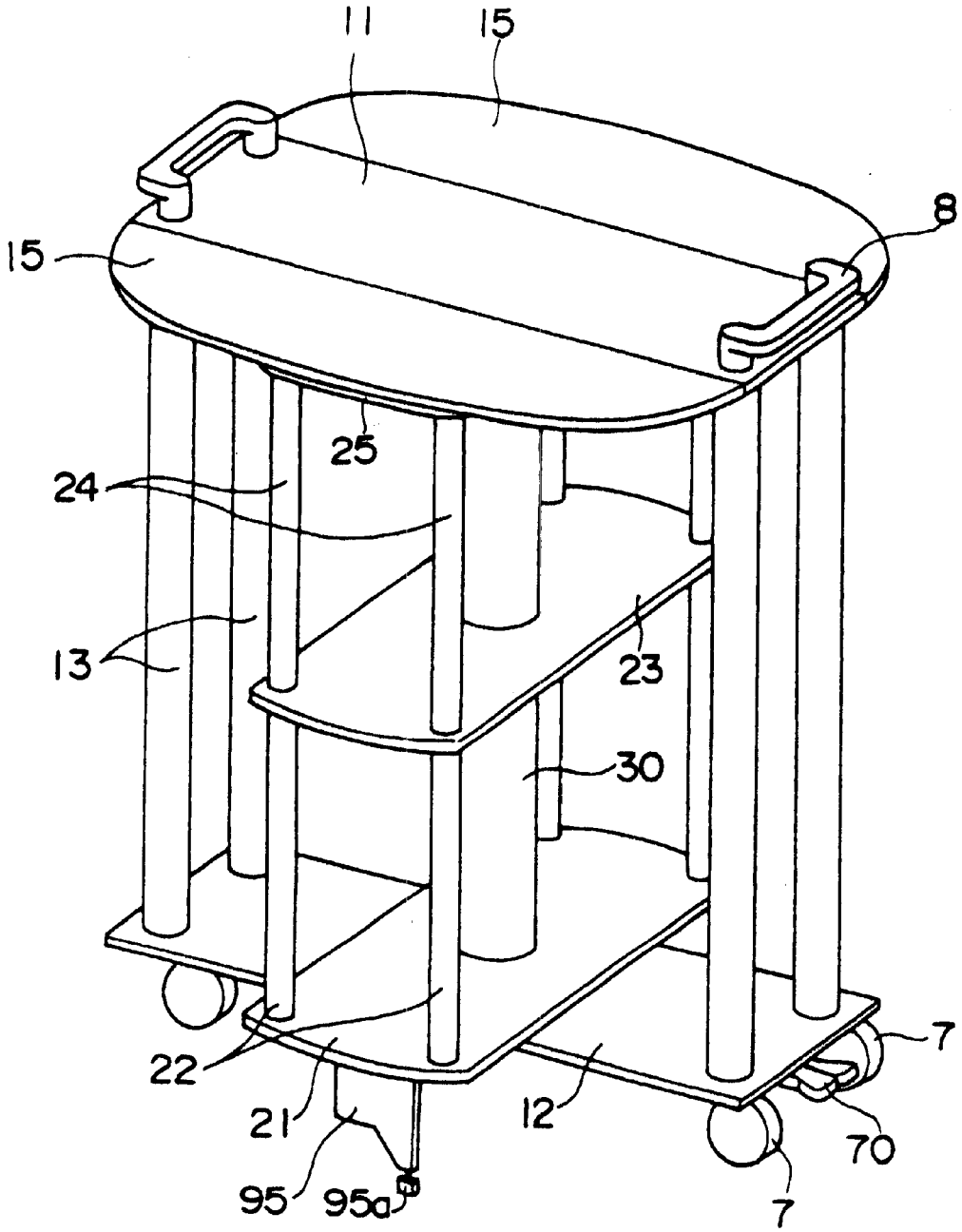
FIG. 5 is a perspective view showing the wagon constituting a table.
Figure 6:
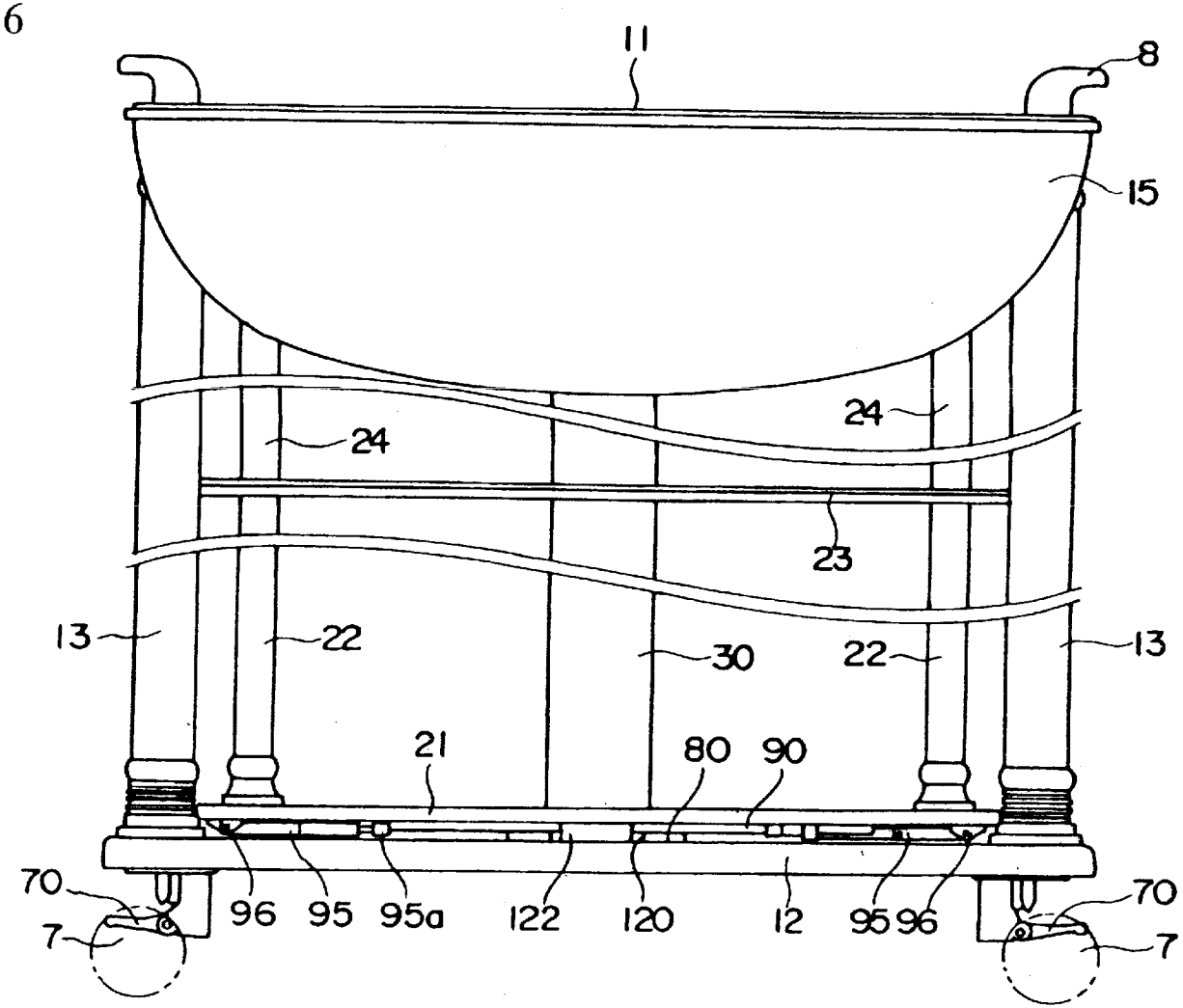
FIG. 6 is a side view of the wagon.
Figure 7:
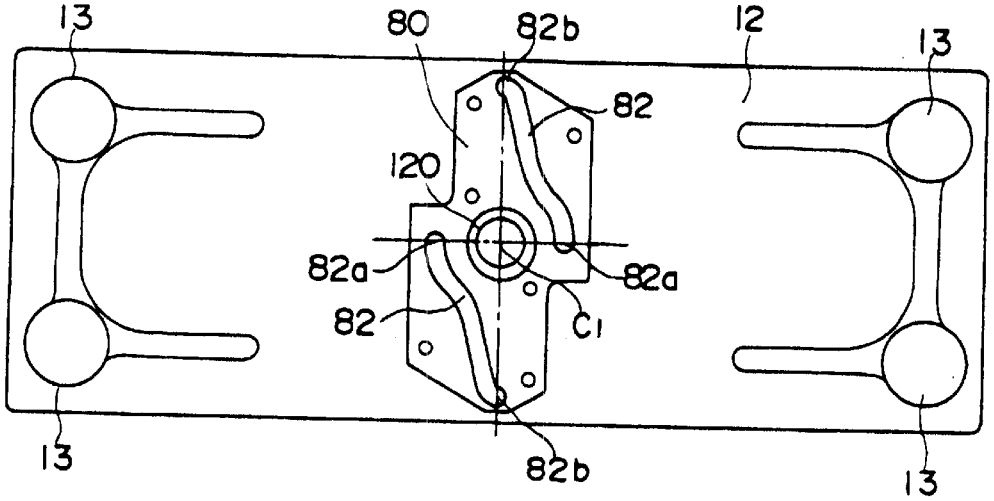
FIG. 7 is a plan view of the bottom plate of the first wagon.

FIG. 1 is an explanatory view showing the whole structure of the wagon according to the present invention, FIGS. 2 and 3 are explanatory drawings of the structure thereof, FIG. 4 is an explanatory view showing the operation of the wagon, and FIG. 5 is an explanatory view showing the state where the wagon is used as a table.

A wagon 1 comprises a first wagon 10 defining the outer frame and a second wagon 20 placed in the interior of the first wagon 10.

As shown in FIG. 2, the first wagon 10 comprises an upper face plate 11, a bottom plate 12, and four columns 13 supporting the upper face plate 11 above the bottom plate 12.

Wheels 7 are mounted on the bottom (back) surface of the bottom plate 12, and handles 8 for moving the wagon 1 toward the direction of arrow a are fixed on the upper face plate 11. A break (not shown) is fixed to the lower surface, and the user can press on a break pedal 70 to operate or release the break. A cam plate 80 is mounted on the center area of the upper surface of the bottom plate 12, the detailed description of which will follow. The cam plate 80 is equipped with a bearing 120 and cam grooves 82.

Auxiliary table plates 15 are rotatably connected on both side edges of the upper face plate 11 along the longitudinal direction of the wagon 1. Usually, the auxiliary table plates 15 hang down from the side edges of the upper face plate 11.

The second wagon 20 comprises a first shelf 21 to be mounted on the bottom plate 12 of the first wagon 10, a second shelf 23 supported by four columns 22 above the first shelf 21, and a third shelf 25 supported by the four columns 24 above the second shelf 23. The size of the second wagon 20 is set so that it can be stored within the interior space of the first wagon 10.

A center pole 30 is fixed to the center area of the first shelf 21.

The center pole 30 is penetrated through a hole 230 formed to the second shelf 23, and is fixed both to the second shelf 23 and the third shelf 25. A rotary convex 31 is formed to the upper surface center of the center pole 30 above the third shelf 25, and the convex 31 is rotatably mounted to a receiving concave 110 fixed to the back surface center of the upper face plate 11 of the first wagon 10.

A pipe-like protrusion 122 is formed on the back surface of the bottom plate 12 of the first shelf 21 corresponding to the position of the center pole 30. The protrusion 122 is rotatably fit to a bearing 120 formed to the cam plate 80 on the bottom plate 12 of the first wagon 10.

As explained, the second wagon 20 is stored in the storage space of the first wagon 10 in position (a first position) with the longitudinal directions of the shelves 21, 23 and 25 matching the longitudinal directions of the bottom plate 12 and the upper face plate 11. Further, the second wagon 20 is capable of being rotated against the first wagon 10 with the center pole 30 acting as the rotation axis.

Folding legs 95 fixed to the back surface of the first shelf 21 of the second wagon 20 are folded and stored to the space between the first shelf 21 and the bottom plate 12 of the first wagon 10.

Next, the mechanism for operating the folding legs 95 is explained (refer to FIGS. 6 through 11).

A bearing 120 and cam grooves 82 are bored to the cam plate 80 mounted to the center area of the bottom plate 12 of the first wagon.

Each cam groove 82 is shaped so that a groove is formed to connect an end 82*a* close to the center C1 of the bearing 120 with an end 82*b* distant from the center C1 of the bearing 120.

A pipe-like protrusion 122 formed to the center of the back surface of first shelf 21 of the second wagon 20 is fit to the bearing 120 formed to the cam plate 80 on the bottom plate 12, thereby rotatably supporting the first shelf 21 of the second wagon 20 on the bottom plate 12 of the first wagon 10.

Figure 8:
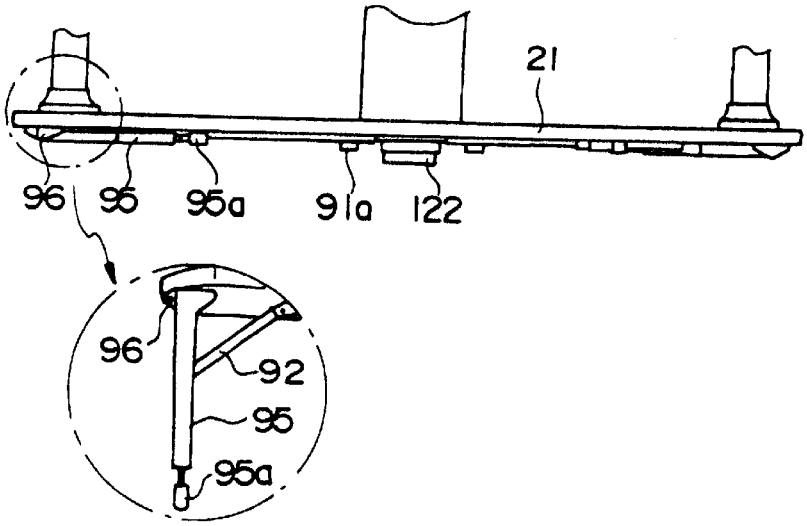
FIG. 8 is a side view showing the bottom plate of the second wagon.
Figure 9:
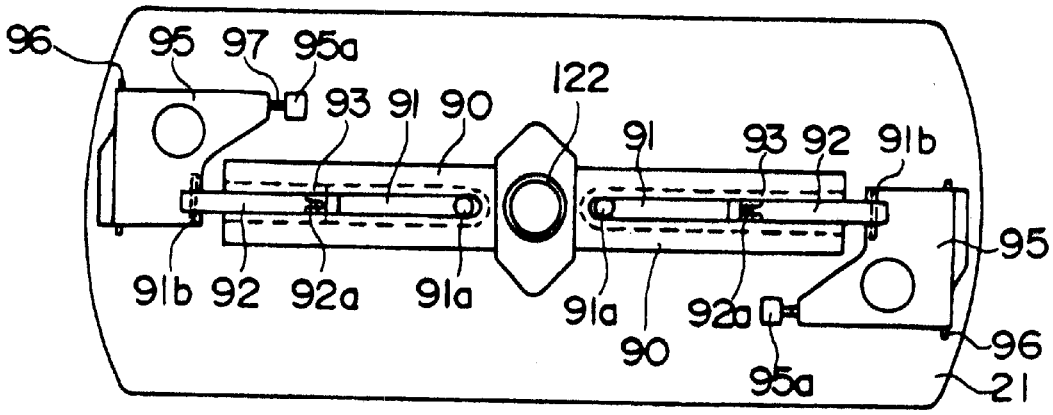
FIG. 9 is a back surface view of the bottom plate of the second wagon.

Moreover, as shown in FIGS. 8 and 9, a slider receive plate 90 is fixed via the protrusion 122 on the back surface of the first shelf 21, and sliders 91 are slidably inserted to the guide grooves 93 formed to the slider receive plate 90.

A pin-like cam follower 91*a* is mounted to the interior end portion of each of the sliders 91, and one end of a link arm 92 is fixed to the outer end portion of each slider 91 via a pin 92*a*.

The other end of the link arm 92 is fixed to the folding leg 95 via a pin 91*b*. Each folding leg 95 is revolvably supported on the back surface of the first shelf 21 by a hinge pin 96.

A cushion member 95*a* is mounted to the end portion of each folding leg 95, with a screw portion 97 that allows adjusting the protrusion length of the member.

The cam follower 91*a* mounted to the slider 91 of the slider receive plate 90 is inserted to the cam groove 82 of the cam plate 80 on the bottom plate 12.

When the second wagon 20 is rotated against the first wagon 10, utilizing the rotation mechanism as explained above, the slider 91 engaged to the movement of the cam follower 91*a* slides within the guide groove 93.

Moreover, along with the rotation of the second wagon 20, the slider 91, guided by the cam groove 82 on the bottom plate 12, moves from position 82*a* close to the rotation center toward position 82*b* away from the rotation center C1. With this movement, the link arm 92 forces the folding leg 95 to open (perpendicular to the bottom surface).

When the second wagon 20 is rotated to an angle of 90 degrees from the first wagon 10, the folding legs 95 open to an angle of 90 degrees downward from the first shelf 21, with the cushion members 95*a* touching the floor surface, thereby stably supporting the second wagon 20 against the floor surface (refer to FIG. 5). The above-explained position of the second wagon 20 is called the second position.

Moreover, when the second wagon 20 is rotated toward the first wagon 10, or to the closing direction, the slider 91 moves toward and drawn into the opposite direction (toward the rotation center C1), and the folding legs 91 are folded and stored to the back surface of the first shelf 21. The second wagon 20 is returned to the first position.

Moreover, accompanied by the rotation of the second wagon 20, the auxiliary table plates 15 are pushed up by the third shelf 25 of the second wagon 20 and moves (pivots) toward arrow c direction, until the plates are horizontally leveled with the upper face plate 11. Thereby, a table formed by connecting auxiliary table plates 15 to the upper face plate 11 is realized by the support provided by the third shelf 25.

Figure 10:
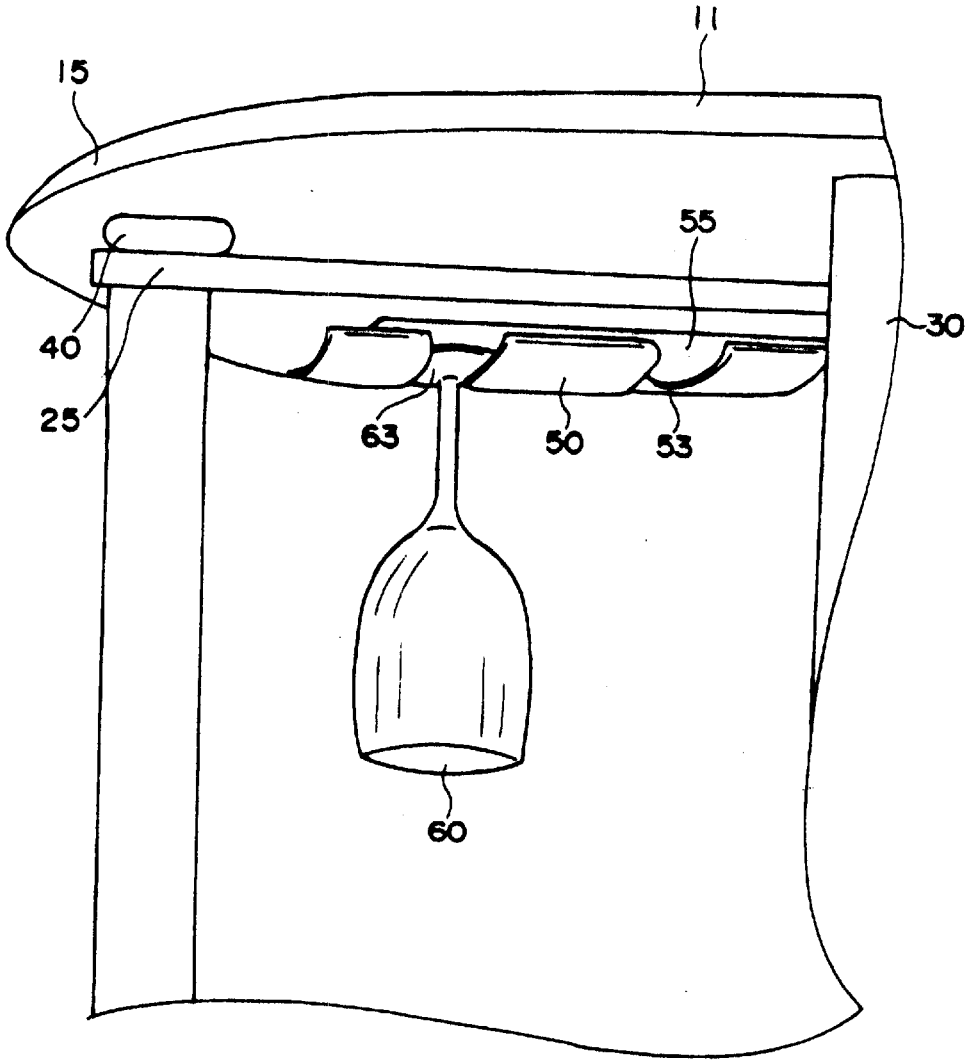
FIG. 10 is a partial enlarged side view of the glass holder.

At this time, a spacer 40 for elastically adjusting the gap formed between the third shelf 25 and the table plate 15 is mounted to the back surface of each auxiliary table plate 15 (refer to FIG. 10).

Moreover, the lower surface of the third shelf 25 of the second wagon 20 is equipped with a glass holder 50.

The glass holder is a plate body made of synthetic resin having flexibility, with a groove 53 formed to the peripheral edge thereof. The leg portion 63 of a wineglass 60 can be supported by the grooves 53 of the glass holder 50. The leg portion 63 of the wineglass 60 is inserted between the glass holder 50 and a pressure contact plate 55 mounted to the back of the glass holder 50. The pressure contact plate 55 restricts the movement of the hanging wineglass 60.

The wagon 1 shown in the present embodiment is placed at the desired position by stopping the wheels using a brake pedal 70. Thereafter, the auxiliary table plates 15 are held up and the second wagon 20 is rotated so that the third shelf 25 acts as a support member for the auxiliary table plates 15. This enables to create a table having a wide area with auxiliary table plates 15 connected to both side edges of the upper faceplate 11 of the first wagon 10.

Simultaneously, when the second wagon 20 is rotated and positioned at an angle of 90 degrees against the first wagon 10, the folding legs 95 are automatically descended from their stored positions to contact the floor surface, and act as stoppers. The second wagon 20 and the auxiliary table plates 15 are supported to position by the folding legs 95, thereby constituting a wagon equipped with an expanding table. Each shelf acts as a storage shelf for mounting tableware and food. Further, wineglasses can be hanged from the back surface of the third shelf 25 of the second wagon 20.

When the wagon is finished to be used as a table, an opposite procedure is followed to rotate the second wagon 20 and to automatically store the folding legs 95, simultaneously storing the auxiliary table plates 15. The brake pedal 70 is released, and the handle 8 is pulled or pushed to move the wagon to the wagon storage position.

Figure 11:
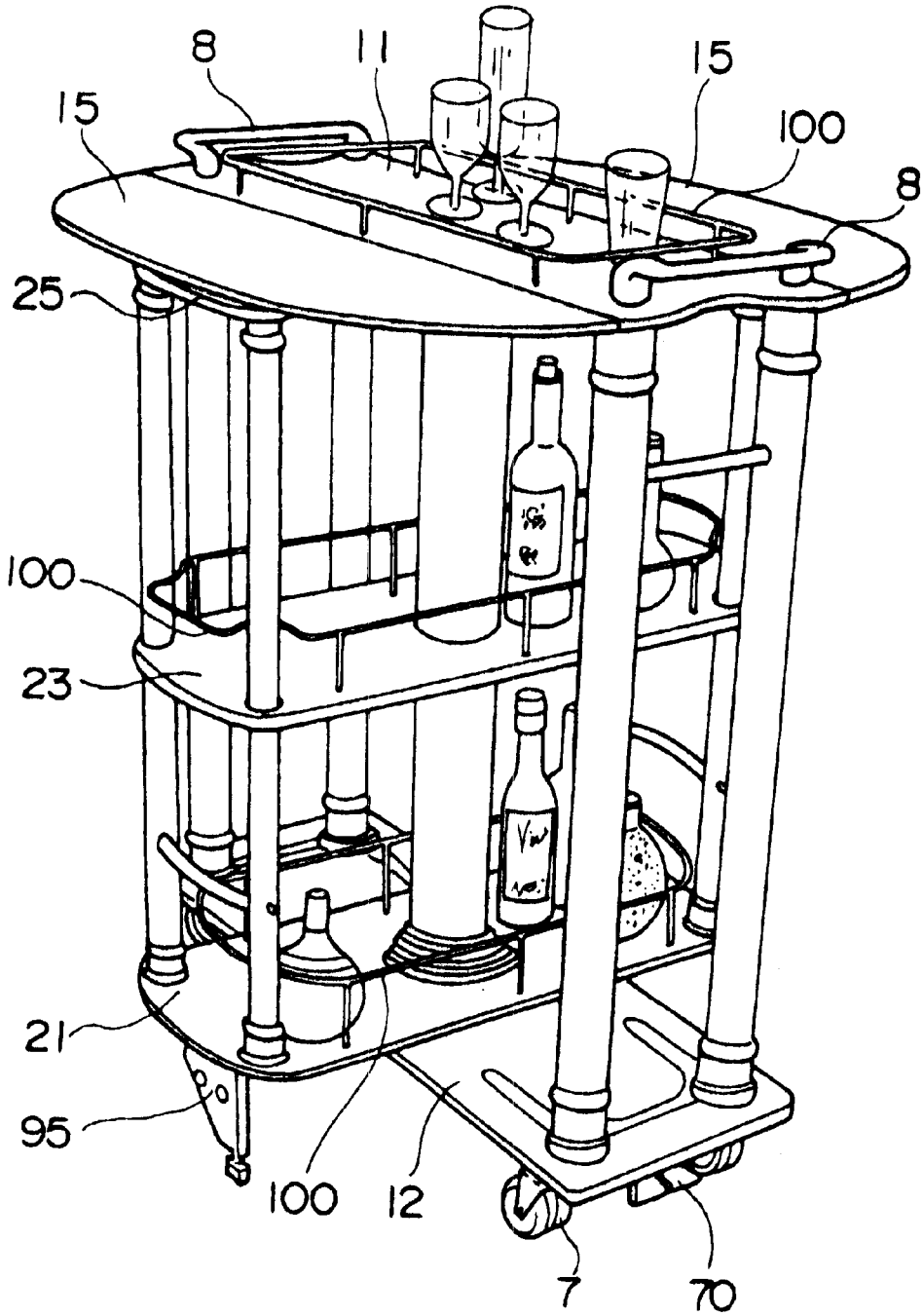
FIG. 11 is a schematic view showing the embodiment of the wagon equipped with guides.

As shown in FIG. 11, a handrail-shaped guide 100 can be provided to the first shelf and the second shelf of the second wagon 20 and the upper face plate 11 of the first wagon, thereby preventing the tableware, container, bottle and the like stored within the guide 100 from falling during movement of the wagon.

The examples for applying the above-explained wagon 1 will now be explained.

Application at Event Sites:

Food, tableware, beverage and the like can be stored in the wagon at a kitchen or a storage position and transported to the event site. According to the size of the event, the wagon can be positioned at any convenient position, where the auxiliary table plates 15 are opened and the upper face constitutes a large table. Then, service is provided using the second wagon 20 as the supporting member and storage for tableware and the like.

Application in Airplanes and Vehicles:

The wagon can be used to deliver service by mounting food and tableware at a kitchen facility and transporting the wagon to passenger seats via the isles. The wagon is set to any voluntary position within the cabin and the brake mechanism of the wagon prevents the wagon from moving by the vibration and the like of the airplane or the vehicle. After expanding the auxiliary table plates 15 to form a large table, the second wagon 20 is used as the support member and storage portion, providing a service station for serving passengers.

The wagon according to the present invention is equipped with connected auxiliary table plates and support mechanism for supporting the expanded auxiliary table plates, thereby realizing a wagon that can be stored and moved as easily as the conventional wagons and further enables to provide a great amount and large varieties of services. Further, when compared to the floor-model tables, the wagon is advantageous in that it can be moved easily to any desired position according to need, enabling mobile services.

We claim:

1. A wagon comprising:

a first wagon having a lower face plate and an upper face plate, a storage space being provided between said lower and upper face plates;

a second wagon having at least a lower face plate and an upper face plate, a storage space being provided between said lower and upper face plates;

an auxiliary table plate connected to the longitudinal side edge of said upper face plate of said first wagon; and transportation wheels mounted to said lower face plate of said first wagon; wherein said second wagon is stored within the storage space of said first wagon and mounted so as to rotate from a first position stored completely within said first wagon to a second position taking an angle of 90 degrees from said first wagon, said auxiliary table plate being arranged to move from a position hanging down from said upper face plate to a position leveled with said upper face plate; and when said second wagon takes said first position, said auxiliary table plate is positioned to hang down from said upper face plate so as to cover the storage space of said first wagon, and when said second wagon takes said second position, said auxiliary table plate pivots and moves to the position leveled with said upper face plate of said first wagon, while said second wagon serves as a supporting member for supporting said auxiliary table plate to said position leveled with said upper face plate of said first wagon.

2. A wagon according to claim 1, wherein said first and second wagons are formed to rotate with the rotation axis positioned at the center of the upper and lower face plates of each wagon.

3. A wagon according to claim 1, wherein said second wagon includes a supporting mechanism mounted on said lower face plate, said supporting mechanism supporting said second wagon to a leveled position when said second wagon is rotated to said second position.

4. A wagon according to claim 3, wherein said supporting mechanism of said second wagon comprises a drive unit that is driven accompanied by the rotation of said second wagon.

5. A wagon according to claim 4, wherein said drive unit of said supporting mechanism on said second wagon includes a cam groove mounted to said lower face plate of said first wagon, and a support member mounted to said lower face plate of said second wagon equipped with a cam follower guided by said cam groove and a link mechanism.

6. A wagon according to claim 1, wherein a glass holder is mounted to the back surface of said upper face plate of said second wagon.

* * * * *